US008790158B2

(12) United States Patent
Chang et al.

(10) Patent No.: US 8,790,158 B2
(45) Date of Patent: Jul. 29, 2014

(54) CHEMICAL MECHANICAL POLISHING APPARATUS

(75) Inventors: One-Moon Chang, Yongin-si (KR); Jae-Phil Boo, Seongnam-si (KR); Jong-Bok Kim, Suwon-si (KR); Soo-Young Tak, Suwon-si (KR); Jong-Sun Ahn, Hwaseong-si (KR); Shin Kim, Hwaseong-si (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 686 days.

(21) Appl. No.: 13/033,876

(22) Filed: Feb. 24, 2011

(65) Prior Publication Data

US 2011/0217910 A1 Sep. 8, 2011

(30) Foreign Application Priority Data

Mar. 3, 2010 (KR) ..... 10-2010-0019171

(51) Int. Cl.
*B24B 49/03* (2006.01)
*B24B 49/12* (2006.01)
*B24B 37/04* (2012.01)

(52) U.S. Cl.
USPC ..... 451/8; 451/6; 451/67; 451/288; 451/289

(58) Field of Classification Search
USPC ..... 451/6, 8, 10, 11, 287, 288, 289, 290, 451/388, 67
See application file for complete search history.

(56) References Cited

U.S. PATENT DOCUMENTS

| | | | | |
|---|---|---|---|---|
| 5,674,115 | A * | 10/1997 | Yamashita et al. | 451/289 |
| 5,964,646 | A * | 10/1999 | Kassir et al. | 451/41 |
| 6,193,586 | B1 * | 2/2001 | Park et al. | 451/41 |
| 7,198,551 | B2 * | 4/2007 | Talieh | 451/41 |
| 7,226,339 | B2 * | 6/2007 | Benvegnu et al. | 451/6 |
| 7,247,209 | B2 * | 7/2007 | Robertson et al. | 134/33 |
| 8,403,732 | B2 * | 3/2013 | Hirayama et al. | 451/385 |
| 2009/0325469 | A1 * | 12/2009 | Koo et al. | 451/54 |

FOREIGN PATENT DOCUMENTS

| | | | |
|---|---|---|---|
| JP | 2009-113145 | A | 5/2009 |
| JP | 2009-135132 | A | 6/2009 |
| KR | 10 2004-00605 | A | 7/2004 |

* cited by examiner

*Primary Examiner* — Timothy V Eley
(74) *Attorney, Agent, or Firm* — Lee & Morse, P.C.

(57) ABSTRACT

A chemical mechanical polishing apparatus includes a platen having a first region configured to support a wafer, and a second region disposed outside the first region. The chemical mechanical polishing apparatus further includes a polishing pad disposed on the platen, a pad head to which the polishing pad is attached, a slurry supply configured to supply a slurry onto the wafer, and an injection port disposing on the second region of the platen. The injection port is configured to inject a predetermined gas to an edge of a bottom surface of the wafer and toward the outside of the wafer.

19 Claims, 6 Drawing Sheets

CHEMICAL MECHANICAL POLISHING APPARATUS

BACKGROUND

1. Field

Embodiments relate to a chemical mechanical polishing (CMP) apparatus for planarizing a surface of a wafer or a layer formed on the wafer.

2. Description of the Related Art

As semiconductor devices become highly integrated and obtain larger capacities, step differences of material layers formed on the semiconductor devices, for example, metal interconnections, also increase. The step differences of the metal interconnections may make it difficult to pattern the metal interconnections. In particular, since step differences of a cell region and a peripheral region in a memory device are increased, the higher the metal interconnections become, the more serious problems related to the step differences become. Therefore, in manufacturing semiconductor devices, a planarization technique for planarizing a material layer or a semiconductor substrate itself is essentially required.

A chemical mechanical polishing (CMP) process, a typical planarization technique among semiconductor manufacturing processes, is a process of planarizing a surface of a wafer or a material layer formed on the wafer by combining a mechanical polishing effect by a polishing agent with a chemical reaction effect by an acid or base solution.

SUMMARY

Embodiments are directed to chemical mechanical polishing (CMP) apparatus for planarizing a surface of a wafer or a layer formed on the wafer, e.g., which may be used as a semiconductor substrate.

Embodiments provide a CMP apparatus capable of reducing, minimizing, and/or preventing a slurry supplied onto a wafer for a polishing process from being introduced between the wafer and a platen for supporting the wafer.

In accordance with an aspect of the embodiments, a chemical mechanical polishing apparatus includes: a platen having a first region configured to support a wafer and a second region disposed outside the first region; a polishing pad disposed on the platen; a pad head to which the polishing pad is attached; a slurry supply configured to supply a slurry onto the wafer; and an injection port disposed at the second region of the platen and configured to inject a predetermined gas to an edge of a bottom surface of the wafer toward the outside of the wafer.

The second region of the platen may be spaced apart a predetermined distance from the wafer.

The apparatus may further include a membrane disposed between the first region of the platen and the wafer.

The membrane may have the same thickness as the spaced predetermined distance between the second region of the platen and the wafer.

The first region of the platen may have one or more vacuum holes, and the membrane may be formed of a porous material.

The first region of the platen may have one or more vacuum holes, and the membrane may have one or more holes corresponding to the vacuum holes.

The first and second regions of the platen may have different thicknesses, and a sum of a difference in thickness between the first and second regions of the platen and the thickness of the membrane may have the same value as the spaced predetermined distance between the second region of the platen and the wafer.

The first and second regions of the platen may have different thicknesses, and the first and second regions of the platen may have the same difference in thickness as the spaced predetermined distance between the second region of the platen and the wafer.

The spaced predetermined distance between the second region of the platen and the wafer may be about 0.7 mm or less.

The apparatus may further include a detector disposed on the platen and measuring a polished level.

The detector may include an end point detector (EPD) sensor.

The predetermined gas injected by the injection port may be nitrogen or air.

In accordance with another aspect of the embodiments, a chemical mechanical polishing apparatus includes: a platen configured to support a wafer; a polishing pad disposed on the platen; a pad head to which the polishing pad is attached; a slurry supply configured to supply a slurry onto a top surface of the wafer; and an injector configured to inject a predetermined gas to an edge of a bottom surface of the wafer toward the outside of the wafer.

The injector may include an injection line configured to transmit the predetermined gas, and an injection port having a closed loop shape extending along an outer circumference of the platen.

The platen may have a relatively smaller size than the wafer, and the injector may be attached to an outer surface of the platen.

The platen may have the same shape as the wafer, and the injection port may have a ring shape.

The injection port may be disposed to face an edge of the bottom surface of the wafer.

The apparatus may further include a membrane disposed between the platen and the wafer.

The platen and the pad head may rotate the wafer and the polishing pad, respectively, and rotational directions of the platen and the pad head may be different from each other.

The polishing pad may have a relatively smaller size than the wafer, and the pad head may reciprocate the polishing pad in a radial direction of the wafer.

BRIEF DESCRIPTION OF THE DRAWINGS

Features will become more apparent to those of ordinary skill in the art by describing in detail exemplary embodiments with reference to the attached drawings, in which.

DETAILED DESCRIPTION

Figure 1:
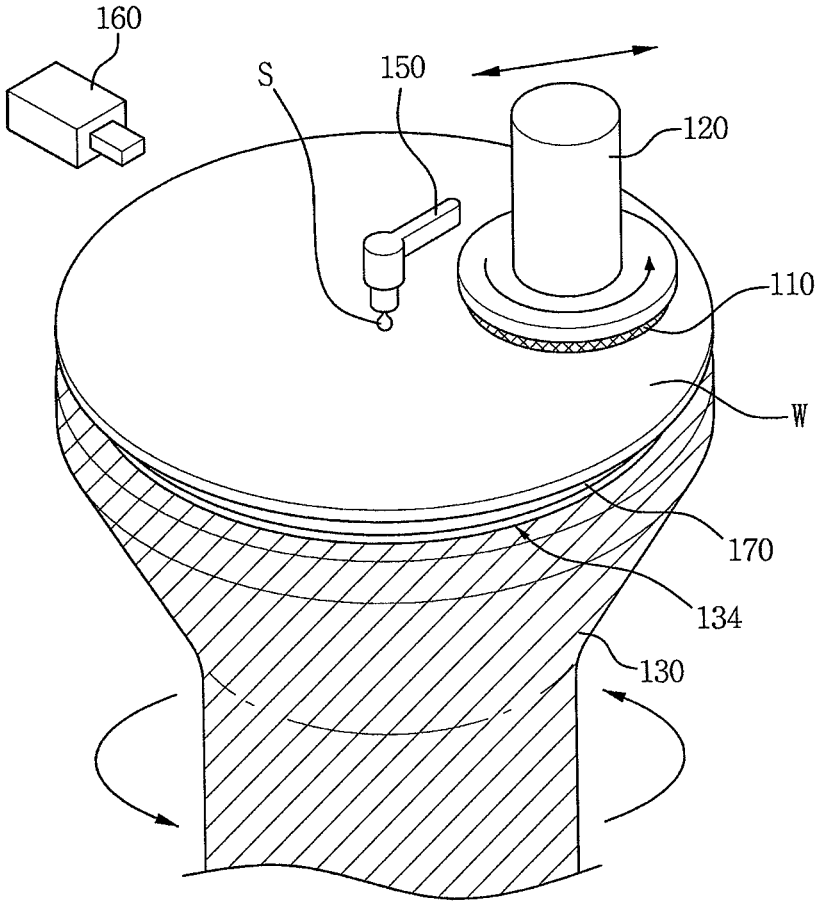
FIG. 1 illustrates a perspective view schematically showing a CMP apparatus in accordance with an exemplary embodiment.

Korean Patent Application No. 10-2010-0019171, filed on Mar. 3, 2010, in the Korean Intellectual Property Office, and entitled: "Chemical Mechanical Polishing Apparatus," is incorporated by reference herein in its entirety.

Various embodiments will now be described more fully with reference to the accompanying drawings in which some embodiments are shown. These inventive concepts may, however, be embodied in different forms and should not be construed as limited to the embodiments set forth herein. Rather, these embodiments are provided so that this disclosure is thorough and complete and fully conveys the inventive concept to those skilled in the art. In the drawings, the sizes and relative sizes of layers and regions may be exaggerated for clarity.

It will be understood that when an element or layer is referred to as being "on," "connected to" or "coupled to" another element or layer, it can be directly on, connected or coupled to the other element or layer or intervening elements or layers may be present. In contrast, when an element is referred to as being "directly on," "directly connected to" or "directly coupled to" another element or layer, there are no intervening elements or layers present. Like numerals refer to like elements throughout. As used herein, the term "and/or" includes any and all combinations of one or more of the associated listed items.

It will be understood that, although the terms first, second, third, etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the present inventive concept.

Spatially relative terms, such as "beneath," "below," "lower," "above," "upper" and the like, may be used herein for ease of description to describe one element's or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the term "below" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the present inventive concept. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments are described herein with reference to cross-sectional illustrations that are schematic illustrations of idealized embodiments (and intermediate structures). As such, variations from the shapes of the illustrations as a result, for example, of manufacturing techniques and/or tolerances, are to be expected. Thus, embodiments should not be construed as limited to the particular shapes of regions illustrated herein but are to include deviations in shapes that result, for example, from manufacturing. For example, an implanted region illustrated as a rectangle will, typically, have rounded or curved features and/or a gradient of implant concentration at its edges rather than a binary change from implanted to non-implanted region. Likewise, a buried region formed by implantation may result in some implantation in the region between the buried region and the surface through which the implantation takes place. Thus, the regions illustrated in the figures are schematic in nature and their shapes are not intended to illustrate the actual shape of a region of a device and are not intended to limit the scope of the present inventive concept.

Unless otherwise defined, all terms (including technical and scientific terms) used herein have the same meaning as commonly understood by one of ordinary skill in the art to which this inventive concept belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

First Exemplary Embodiment

Figure 2A:
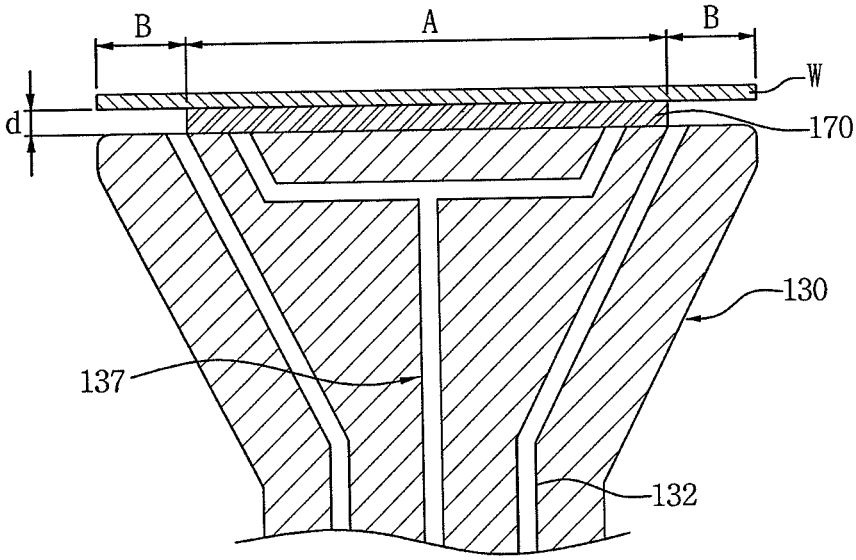
FIG. 2A illustrates a cross-sectional view of a platen of the CMP apparatus in accordance with an exemplary embodiment.
Figure 2B:
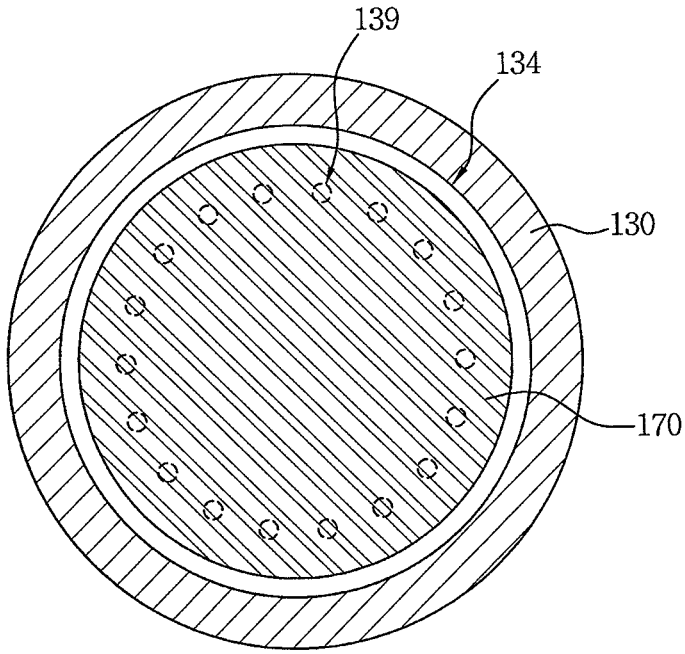
FIG. 2B illustrates a plan view of the platen of the CMP apparatus in accordance with an exemplary embodiment.

FIG. 1 is a perspective view schematically showing a CMP apparatus in accordance with a first exemplary embodiment, FIG. 2A is a cross-sectional view of a platen of the CMP apparatus in accordance with a first exemplary embodiment, and FIG. 2B is a plan view of the platen of the CMP apparatus in accordance with a first exemplary embodiment.

Referring to FIGS. 1, 2A, and 2B, the CMP apparatus in accordance with a first exemplary embodiment includes a platen 130 having a first region A configured to support a wafer W and a second region B disposed outside the first region A, a polishing pad 110 disposed on the platen 130, a pad head 120 to which the polishing pad 110 is attached, a slurry supply 150 configured to supply a slurry S onto the wafer W supported by the platen 130, and an injection port 134 disposed at the second region B of the platen 130 and configured to inject a predetermined gas to an edge of a bottom surface of the wafer W toward the outside of the wafer W.

Here, the CMP apparatus in accordance with a first exemplary embodiment further includes a gas supply (not shown) configured to supply a predetermined gas injected by the injection port 134. The gas supply is connected to the injection port 134 via an injection line 132 disposed in the platen 130.

The polishing pad 110 contacts one surface of the wafer W and polishes the surface with a certain pressure. Therefore, the polishing pad 110 may be formed of a polyurethane matrix material having relatively larger friction strength than the wafer W. Here, polyurethane is any polymer consisting of a chain of urethane links, in which an isocyanate functional group is reacted with an alcohol group.

In addition, the polishing pad 110 is rotated by the pad head 120 at a predetermined speed while in contact with the wafer W. Therefore, the polishing pad 110 may have one or more grooves (not shown) having a certain pattern such that the slurry S supplied by the slurry supply 150 can be uniformly applied between the polishing pad 110 and the wafer W.

The pad head 120 rotates and moves the polishing pad 110 such that the wafer W may be uniformly polished by the polishing pad 110. That is, when the polishing pad 110 has a relatively smaller size than the wafer W, the pad head 120 rotates the polishing pad 110 and reciprocates the polishing pad 110 in a radial direction of the wafer W.

The slurry supply 150 is configured to supply the slurry S onto the wafer W. Here, the slurry S may contain, e.g., nano powder particulates uniformly distributed for mechanical polishing, and an acid or base solution diluted with distilled water or ultrapure water for chemical reaction with the wafer W to be polished.

The platen 130 supports and rotates the wafer W during the polishing process. The platen 130 includes a first region A configured to support the wafer W and a second region B disposed outside the first region A and in which the injection port 134 is positioned. Here, the predetermined gas should not damage the wafer W or a layer formed on the wafer W during the polishing process. Therefore, the predetermined gas may be, e.g., nitrogen gas (N2) or air.

A rotational direction of the wafer W by the platen 130 may be opposite to the rotational direction of the polishing pad 110 by the pad head 120. In addition, the platen 130 and the pad head 120 may rotate the wafer W and the polishing pad 110 in the same direction.

The second region B of the platen 130 provides a path through which the predetermined gas injected by the injection port 134 can move to the outside of the platen 130. For this purpose, in the CMP apparatus in accordance with a first exemplary embodiment, the second region B of the plate 130 may be spaced apart a predetermined distance d from the other surface of the wafer W.

Therefore, the CMP apparatus in accordance with a first exemplary embodiment may include a membrane 170 disposed between the first region A of the platen 130 and the wafer W and having the same thickness as the spaced predetermined distance d between the second region B of the platen 130 and the wafer W.

Figure 3A:
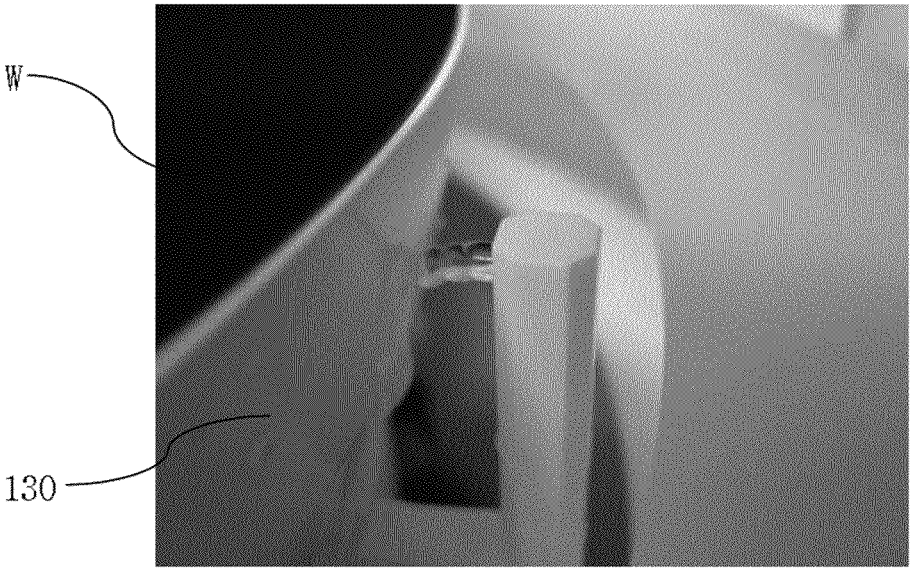
FIGS. 3A and 3B are images illustrating initial process results according to a spaced predetermined distance between a wafer and a second region of the platen configured to support the wafer, in the CMP apparatus in accordance with an exemplary embodiment.
Figure 3B:
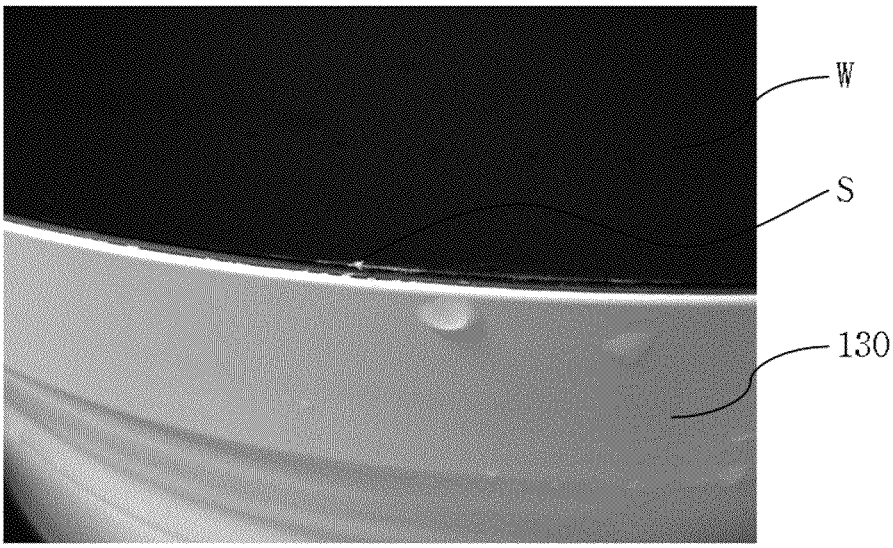

FIG. 3A shows an image of initial process results when the spaced predetermined distance d between the second region B of the platen 130 and the wafer W is about 0.7 mm or less. FIG. 3B shows an image of initial process results when the spaced predetermined distance d between the second region B of the platen 130 and the wafer W is larger than about 0.7 mm.

Referring to FIG. 3A, it will be appreciated, without intending to be bound by this theory, that the slurry S supplied onto the wafer W is substantially totally and/or totally blown out when the spaced predetermined distance d between the second region B of the platen 130 and the wafer W is about 0.7 mm or less.

On the other hand, referring to FIG. 3B, it will be appreciated, without intending to be bound by this theory, that the slurry S is stuck to the edge of the wafer W when the spaced predetermined distance d is larger than about 0.7 mm. The slurry S stuck to the edge of the wafer W may be accumulated by the following processes.

Therefore, when the spaced predetermined distance d between the second region B of the platen 130 and the wafer W is larger than about 0.7 mm, the slurry S may be introduced between the wafer W and the platen 130.

In the CMP apparatus in accordance with a first exemplary embodiment, the spaced predetermined distance d between the second region B of the platen 130 and the wafer W may be about 0.7 mm or less. The predetermined distance d may be within narrower ranges that include, but are not limited to, about 0.5 mm or less, about 0.3 mm or less, and about 0.1 mm or less.

Hereinafter, the CMP apparatus in accordance with a first exemplary embodiment will be described again with reference to FIGS. 1, 2A, and 2B. The injection port 134 injects the predetermined gas toward the outside of the wafer W. Therefore, the slurry S flowing along the edge of the wafer W is blown out toward the outside of the wafer W. The injection port 134 may have a closed loop curve formed along the edge of the platen 130.

Here, when the platen 130 has a circular periphery as shown in FIGS. 1 and 2B, the injection port 134 may have a ring shape. In addition, the platen 130 may have a polygonal periphery, different from the wafer W having a circular periphery.

The injection port 134 may be disposed to face the edge of the bottom surface of the wafer W as shown in FIGS. 1, 2A, and 2B.

The first region A of the platen 130 may further include one or more vacuum holes 139 connected to a vacuum pump (not shown) through a vacuum line 137. Here, the membrane 170 disposed between the first region A of the platen 130 and the wafer W may be formed of a porous material.

The vacuum holes 139 can prevent the edge of the wafer W from coming off. For this purpose, the vacuum holes 139 may be disposed at the edge of the first region A, on which the platen 130 is mounted.

The CMP apparatus in accordance with a first exemplary embodiment may further include a detector 160 configured to measure a polished level of the wafer W. Here, the detector 160 may include an end point detector (EDP) sensor.

Hereinafter, the CMP process in accordance with an exemplary embodiment will be described with reference to FIGS. 1, 2A, and 2B. First, the platen 130 having the first region A and the second region B disposed outside the first region A is provided. Here, the injection port 134 is disposed at the second region B of the platen 130 to inject the predetermined gas toward the outside of the platen 130.

Next, the wafer W is supported by the first region A of the platen 130. Continuously, the pad head 120, to which the polishing pad 110 is attached, is disposed on the wafer W such that the polishing pad 110 faces the wafer W.

Here, the process of supporting the wafer W through the first region A of the platen 130 may include spacing the second region B of the platen 130 a predetermined distance d apart from the bottom surface of the wafer W. The predetermined distance d may be about 0.7 mm or less as described with reference to FIGS. 3A and 3B.

The CMP apparatus in accordance with a first exemplary embodiment includes a membrane 170 disposed between the first region A of the platen 130 and the wafer W and having the same thickness as the predetermined distance d.

In addition, the process of supporting the wafer W through the first region A of the platen 130 may include suctioning the wafer W to the first region A of the platen 130 using one or more vacuum holes 139. Here, the platen 130 further includes a vacuum line 137 configured to connect the one or more vacuum holes 139 to the vacuum pump.

Continuing, the pad head 120 and the platen 130 are rotated to rotate the polishing pad 110 and the wafer W. Here, as described above, rotational directions of the polishing pad 110 and the wafer W may be the same as or different from each other.

Next, the slurry S is supplied onto the wafer W to be applied on the wafer W. Here, the process of rotating the wafer W and the polishing pad 110 may be performed after supply of the slurry S onto the wafer W.

Then, the predetermined gas is injected to the edge of the bottom surface of the wafer W toward the outside of the wafer W using the injection port 134. The injected predetermined gas reduces, minimizes, and/or prevents the slurry S spread by the rotational force of the wafer W from being introduced between the wafer W and the platen 130. Here, the process of injecting the predetermined gas using the injection port 134 may be performed simultaneously with supply of the slurry S.

In addition, when the wafer W is rotated after supply of the slurry S onto the wafer W, the predetermined gas may be injected simultaneously with the rotation of the wafer W.

Next, the polishing pad 110 contacts the wafer W at a predetermined pressure to perforin a polishing process. Here, after completion of the polishing process, a process of cleaning the wafer W may be further performed.

Eventually, during the polishing process, the CMP apparatus in accordance with a first exemplary embodiment injects the predetermined gas to the edge of the wafer toward the outside of the wafer using the injection port disposed at the edge of the platen configured to support the wafer. Therefore, it is possible to reduce, minimize, and/or prevent the slurry supplied onto the wafer from being introduced between the wafer and the platen along the edge of the wafer.

Second Exemplary Embodiment

Figure 4A:
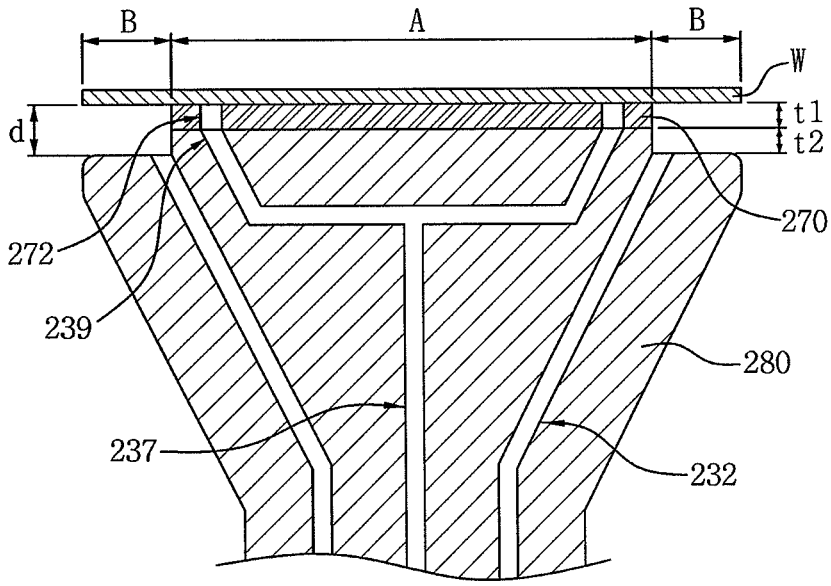
FIG. 4A illustrates a cross-sectional view of a platen of a CMP apparatus in accordance with an exemplary embodiment.
Figure 4B:
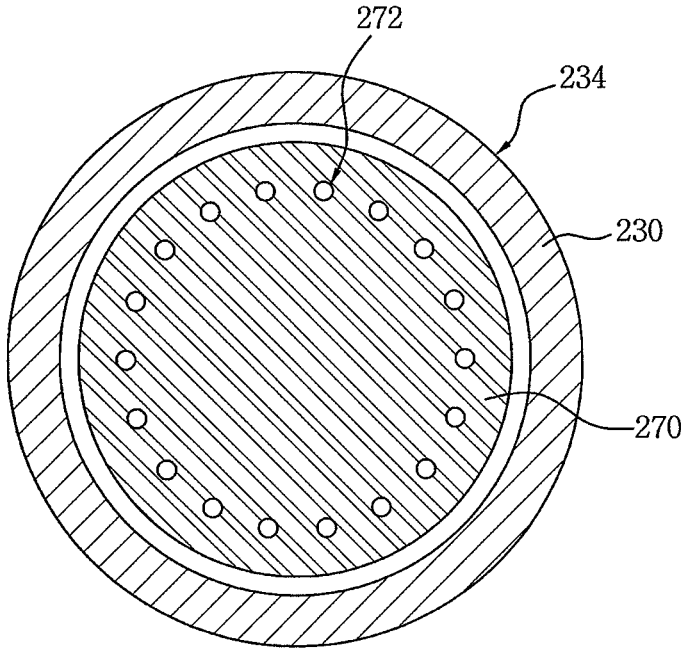
FIG. 4B illustrates a plan view of the platen of the CMP in accordance with an exemplary embodiment.

FIG. 4A is a cross-sectional view of a platen of a CMP apparatus in accordance with a second exemplary embodiment, and FIG. 4B is a plan view of the platen of the CMP in accordance with a second exemplary embodiment.

The CMP apparatus in accordance with a second exemplary embodiment is similar to that of the first exemplary embodiment except that structure of the platen 130 is modified. A method of spacing the second region B of the platen 130 a predetermined distance d apart from the wafer W will be described below.

Therefore, the CMP apparatus in accordance with a second exemplary embodiment has the same constitution as that of the first exemplary embodiment except for the platen 130.

Referring to FIGS. 4A and 4B, a platen 230 of the CMP apparatus in accordance with a second exemplary embodiment includes a first region A and a second region B similar to the platen 130 of the CMP apparatus of the first exemplary embodiment. The first region A may be configured to support a wafer W, and the second region B may be disposed outside the first region A and may be spaced apart a predetermined distance d from the other surface of the wafer W.

In addition, an injection port 234 is disposed at the second region B of the platen 230 to inject a predetermined gas to an edge of a bottom surface of the wafer W toward the outside of the wafer W.

The platen 230 of the CMP apparatus in accordance with a second embodiment includes the first region A and the second region B having different thicknesses, unlike the platen 130 of the CMP apparatus in accordance with a first exemplary embodiment. That is, in the platen 230 of the CMP apparatus in accordance with a second exemplary embodiment, the first region B configured to support the wafer W has a relatively larger thickness than the second region N, on which the injection port 234 is disposed, by a predetermined thickness t1.

Therefore, a membrane 270 disposed between the first region A of the platen 230 and the wafer W has a relatively smaller thickness t2 than the membrane 170 of the CMP apparatus in accordance with a first exemplary embodiment.

In addition, a sum of the difference in thickness t1 between the first and second regions A and B of the platen 230 and the thickness of the membrane 270 disposed between the first region A of the plate 230 and the wafer W is the same as the spaced predetermined distance d between the second region B of the platen 230 and the wafer W.

Unlike the above, in the CMP apparatus in accordance with a second exemplary embodiment, the first and second regions A and B of the platen 230 may have the same difference in thickness t1 as the spaced predetermined distance d between the second region B of the platen 230 and the wafer W.

The platen 230 of the CMP apparatus in accordance with a second exemplary embodiment has one or more vacuum holes 239, like the platen 130 of the CMP apparatus in accordance with a first exemplary embodiment.

The membrane 270 may be formed of the same porous material as the membrane 170 of the first exemplary embodiment. In addition, as shown in FIGS. 4A and 4B, the membrane 239 may include one or more holes 272 corresponding to the vacuum holes 239.

Eventually, in the CMP apparatus in accordance with a second exemplary embodiment, the platen includes the first region configured to support the wafer and the second region on which the injection port is disposed, which have different thicknesses from each other. Therefore, in the CMP apparatus in accordance with a second exemplary embodiment, the second region of the platen can be spaced a predetermined distance d apart from the wafer using the structure of the platen only.

Third Exemplary Embodiment

Figure 5:
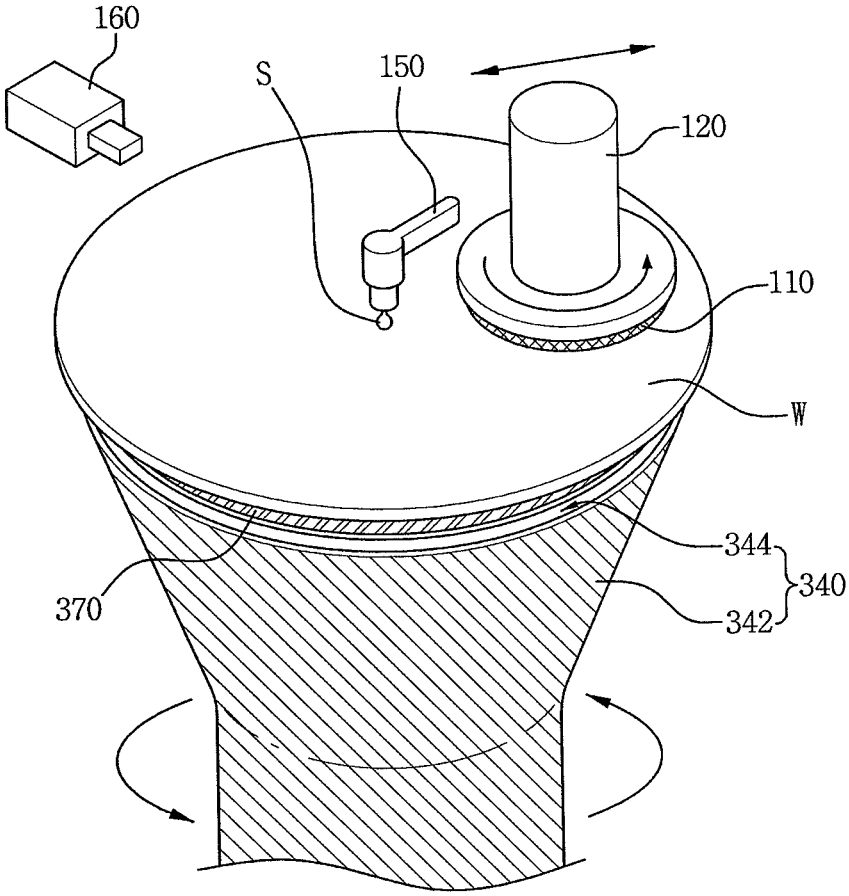
FIG. 5 illustrates a perspective view schematically showing a CMP apparatus in accordance with an exemplary embodiment.
Figure 6A:
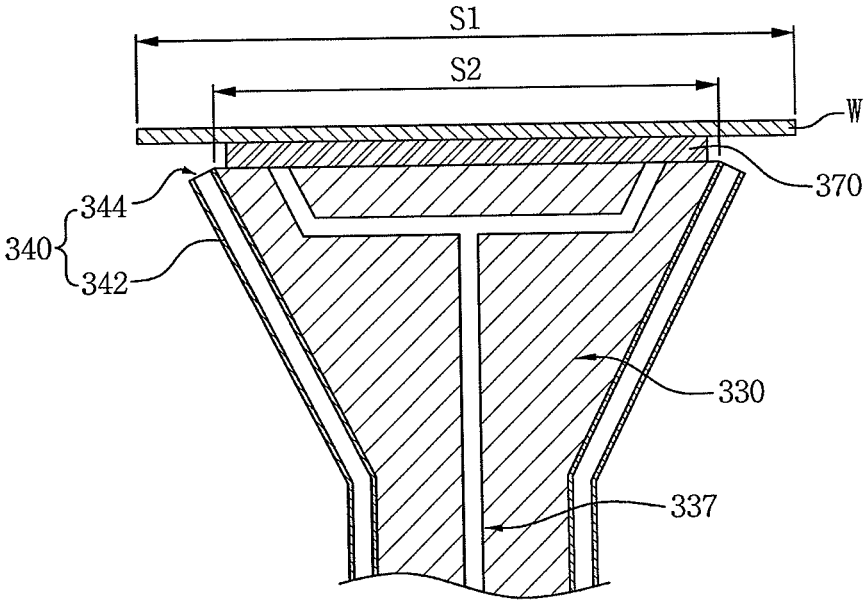
FIG. 6A illustrates a cross-sectional view of a platen of the CMP apparatus in accordance with an exemplary embodiment.
Figure 6B:
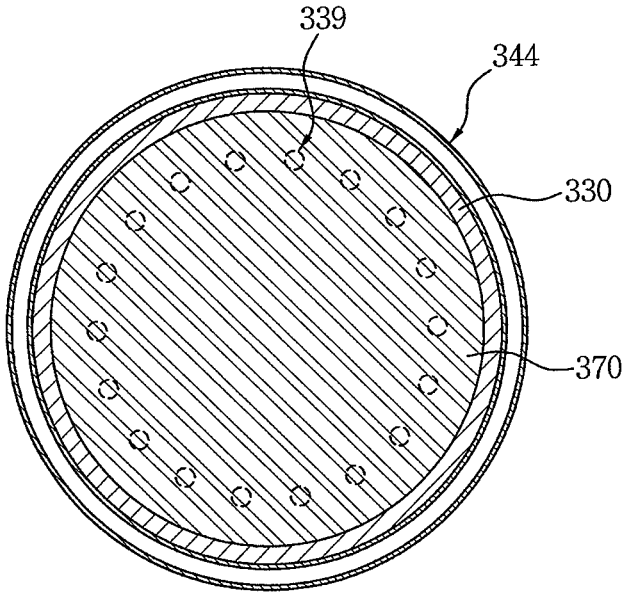
FIG. 6B illustrates a plan view of the platen of the CMP apparatus in accordance with an exemplary embodiment.

FIG. 5 is a perspective view schematically showing a CMP apparatus in accordance with a third exemplary embodiment, FIG. 6A is a cross-sectional view of a platen of the CMP apparatus in accordance with a third exemplary embodiment, and FIG. 6B is a plan view of the platen of the CMP apparatus in accordance with a third exemplary embodiment.

Referring to FIGS. 5, 6A and 6B, the CMP apparatus in accordance with a third exemplary embodiment includes a platen 330 configured to support a wafer W having a first diameter S1 and having a second diameter S2 relatively smaller than that of the wafer W, a polishing pad 110 disposed on the platen 330, a pad head 120 to which the polishing pad 110 is attached, a slurry supply 150 configured to supply a slurry S onto the wafer W supported by the platen 330, and an injector 340 attached to the outer surface of the platen 330 and injecting a predetermined gas to an edge of a bottom surface of the wafer W toward the outside of the wafer W.

The polishing pad 110, the pad head 120 and the slurry supply 150 of the CMP apparatus in accordance with a third exemplary embodiment are the same as those of the CMP apparatus in accordance with a first exemplary embodiment, and thus, detailed description thereof will not be repeated.

The platen 330 is configured to support and rotate the wafer W during a polishing process. Here, the CMP apparatus in accordance with a third exemplary embodiment may further include a membrane 370 disposed between the platen 330 and the wafer W. In addition, the platen 330 may have one or more vacuum holes 339 connected to a vacuum pump (not shown) via a vacuum line 337, similar to the first region A of the platen 130 of the first exemplary embodiment and the first region A of the platen 230 of the second exemplary embodiment.

In addition, the CMP apparatus in accordance with a third exemplary embodiment may further include a membrane 370 disposed between the platen 330 and the wafer W. The membrane 370 may be formed of the same porous material as in the first exemplary embodiment. Further, the membrane 370 may include one or more holes (not shown) corresponding to the vacuum holes 339, similar to the second exemplary embodiment.

The injector 340 injects a predetermined gas to an edge of a bottom surface of the wafer W. For this purpose, the injector 340 includes an injection line 332 attached to the outer surface of the platen 330, and an injection port 334 having a closed loop shape extending along an outer circumference of the platen 330. Here, the injection line 332 connects the injection port 334 to a gas supply (not shown) configured to supply a predetermined gas into the injection port 334.

The injection port 334 injects the predetermined gas to blow the slurry S flowing along the edge of the wafer W toward the outside of the wafer W. The injection port 334 may have a ring shape as shown in FIG. 6B. Unlike the above, when the outer circumference of the platen 130 has a polygonal shape, the injection port 334 may have a closed loop curve with a polygonal shape.

The injection port 334 may be disposed to face the edge of the bottom surface of the wafer W, similar to the first exemplary embodiment.

Eventually, when the platen configured to support the wafer has a relatively smaller size than the wafer, the CMP apparatus in accordance with a third exemplary embodiment includes the injection line attached to the outer surface of the platen. Therefore, regardless of the size ratio of the platen and the wafer, the predetermined gas can be easily injected to the edge of the wafer.

As can be seen from the foregoing, a chemical mechanical polishing apparatus uses an injection port attached to an inside or an outer surface of the platen configured to support a wafer to reduce, minimize, and/or prevent a slurry supplied onto the wafer from being introduced between the wafer and the platen, improving reliability and durability of the apparatus. The chemical mechanical polishing apparatus may improve reliability and durability.

The foregoing is illustrative of embodiments and is not to be construed as limiting thereof. Although a few embodiments have been described, those skilled in the art will readily appreciate that many modifications are possible in embodiments without materially departing from the novel teachings and advantages. Accordingly, all such modifications are intended to be included within the scope of this inventive concept as defined in the claims. In the claims, means-plus-function clauses are intended to cover the structures described herein as performing the recited function, and not only structural equivalents but also equivalent structures. Therefore, it is to be understood that the foregoing is illustrative of various embodiments and is not to be construed as limited to the specific embodiments disclosed, and that modifications to the disclosed embodiments, as well as other embodiments, are intended to be included within the scope of the appended claims.

Exemplary embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of ordinary skill in the art that various changes in form and details may be made without departing from the spirit and scope of the present invention as set forth in the following claims.

What is claimed is:

1. A chemical mechanical polishing apparatus, comprising:

a platen having a first region configured to support a wafer and a second region disposed outside the first region;

a polishing pad locatable on the platen;

a pad head to which the polishing pad is attached;

a slurry supply configured to supply a slurry onto the wafer; and an injection port disposed at the second region of the platen, and configured to inject a predetermined gas to an edge of a bottom surface of the wafer and toward the outside of the wafer, wherein the injection port has a closed loop shape extending along an outer circumference of the first region of the platen.

2. The apparatus as claimed in claim 1, wherein the second region of the platen is spaced apart by a predetermined distance from the wafer when the wafer is mounted on the first region of the platen.

3. The apparatus as claimed in claim 2, further comprising a membrane disposed on the first region of the platen.

4. The apparatus as claimed in claim 3, wherein a level of an upper surface of the first region of the platen is the same as a level of an upper surface of the second region of the platen.

5. The apparatus as claimed in claim 3, wherein the first region of the platen includes one or more vacuum holes, and the membrane includes a porous material.

6. The apparatus as claimed in claim 3, wherein the first region of the platen includes one or more vacuum holes, and the membrane includes one or more holes corresponding to the vacuum holes.

7. The apparatus as claimed in claim 3, wherein the first and second regions of the platen have different thicknesses, and a sum of a difference in thickness between the first and second regions of the platen and the thickness of the membrane has a same value as the predetermined distance between the second region of the platen and the wafer.

8. The apparatus as claimed in claim 2, wherein the first and second regions of the platen have different thicknesses, and a difference in thickness between the first and second regions of the platen has a same value as the predetermined distance between the second region of the platen and the wafer.

9. The apparatus as claimed in claim 2, wherein the predetermined distance between the second region of the platen and the wafer is about 0.7 mm or less.

10. The apparatus as claimed in claim 1, further comprising a detector configured to measure a polished level.

11. The apparatus as claimed in claim 10, wherein the detector includes an end point detector (EPD) sensor.

12. The apparatus as claimed in claim 1, wherein the predetermined gas injected by the injection port is nitrogen or air.

13. A chemical mechanical polishing apparatus, comprising:

a platen configured to support a wafer;

a polishing pad locatable on the platen;

a pad head to which the polishing pad is attached;

a slurry supply configured to supply a slurry onto a top surface of the wafer; and an injector configured to inject a predetermined gas to an edge of a bottom surface of the wafer and toward the outside of the wafer, wherein the injector includes an injection line configured to transmit the predetermined gas and an injection port having a closed loop shape extending along an outer circumference of the platen.

14. The apparatus as claimed in claim 13, wherein the platen supports the wafer, the platen has a smaller size than the wafer, and the injector is attached to an outer surface of the platen.

15. The apparatus as claimed in claim 13, wherein the platen supports the wafer, the platen has a same shape as the wafer, and the injection port has a ring shape.

16. The apparatus as claimed in claim 13, wherein the platen supports the wafer, and the injection port faces an edge of the bottom surface of the wafer.

17. The apparatus as claimed in claim 13, wherein the platen supports the wafer, and the apparatus further comprises a membrane disposed between the platen and the wafer.

18. The apparatus as claimed in claim 13, wherein the platen supports the wafer, the platen and the pad head rotate the wafer and the polishing pad, respectively, and rotational directions of the platen and the pad head are different from each other.

19. The apparatus as claimed in claim 13, wherein the platen supports the wafer, the polishing pad has a smaller size than the wafer, and the pad head reciprocates the polishing pad in a radial direction of the wafer.

* * * * *